United States Patent [19]

Tate, Jr. et al.

[11] Patent Number: 4,694,553

[45] Date of Patent: Sep. 22, 1987

[54] METHOD OF MANUFACTURING REFRIGERATION APPARATUS CABINET CONSTRUCTION UTILIZING PREPAINTED STEEL PANELS

[75] Inventors: Ralph Tate, Jr., Center Township, Vanderburgh County; John T. Woods, Scott Township, Vanderburgh County, both of Ind.

[73] Assignee: Whirlpool Corporation, Benton Harbor, Mich.

[21] Appl. No.: 931,391

[22] Filed: Nov. 13, 1986

Related U.S. Application Data

[62] Division of Ser. No. 633,214, Jul. 19, 1984, Pat. No. 4,640,432.

[51] Int. Cl.[4] ..... B23P 9/00

[52] U.S. Cl. ..... 29/445; 29/446; 29/460; 29/458

[58] Field of Search ..... 29/455 R, 460, 458, 29/445; 220/66, 67, 75, 76, 81 R, 467; 312/214

[56] References Cited

U.S. PATENT DOCUMENTS

| | | | |
|---|---|---|---|
| 2,304,833 | 12/1942 | Korwan | 29/460 UX |
| 3,412,203 | 11/1968 | D'Angelo | 29/460 UX |
| 3,653,116 | 4/1972 | Lov et al. | 29/445 UX |
| 3,811,173 | 5/1974 | Baumann | 29/460 |
| 3,948,410 | 4/1976 | Anderson | 312/214 X |
| 4,040,166 | 8/1977 | Morphy | 29/460 |
| 4,162,571 | 7/1979 | Horvay | 29/460 |
| 4,296,540 | 10/1981 | Potter | 29/460 |
| 4,348,068 | 9/1982 | Hawkins et al. | 312/214 X |
| 4,554,037 | 11/1985 | Goodlaxson | 29/460 X |

FOREIGN PATENT DOCUMENTS

| | | | |
|---|---|---|---|
| 465640 | 9/1951 | Italy | 220/75 |

*Primary Examiner*—Charlie T. Moon

*Attorney, Agent, or Firm*—Wood, Dalton, Phillips, Mason & Rowe

[57] ABSTRACT

A cabinet structure wherein a deck member has deflectible side edge portions cooperating with the sidewalls of the cabinet structure to form a sealing cavity. A hot melt sealant is provided in the sealing cavity to form a barrier during the in situ formation of foamed insulation in the cabinet structure. The edge portions of the deck member are deflectible about hinge lines and are formed of sheet metal so as to define a facial engagement with the sidewalls of the cabinet without substantial bulging or deformation thereof, and permitting the sidewalls to be formed of prepainted sheet metal.

4 Claims, 4 Drawing Figures

FIG. 1
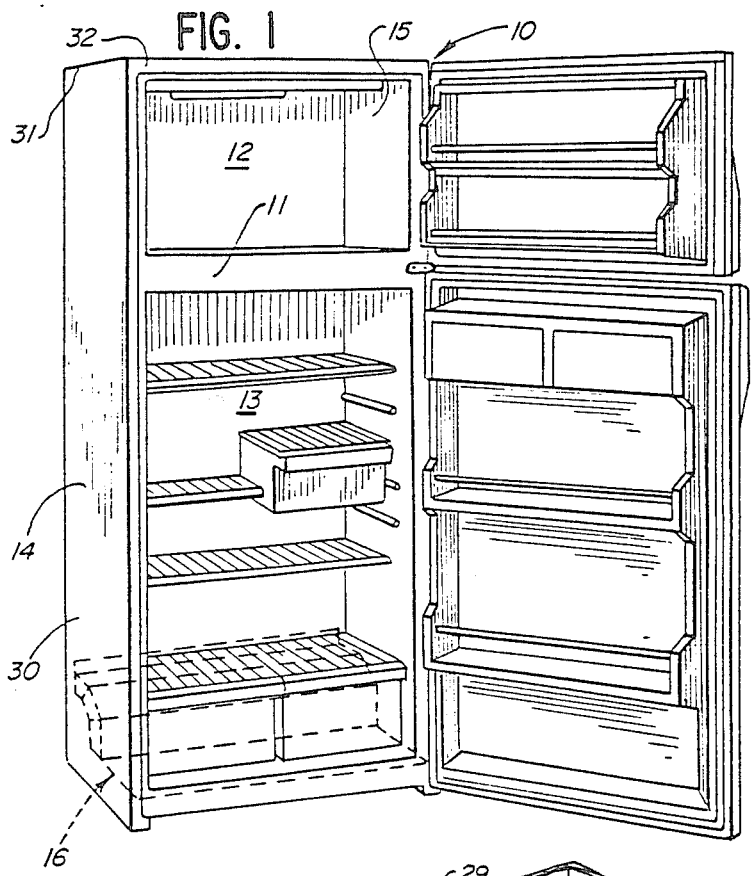
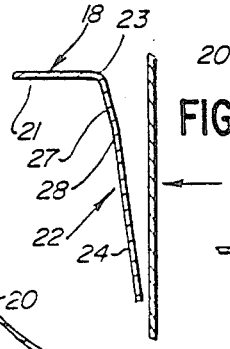
FIG. 3
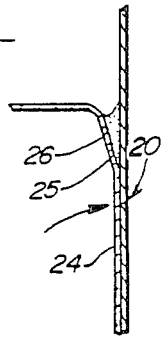
FIG. 4
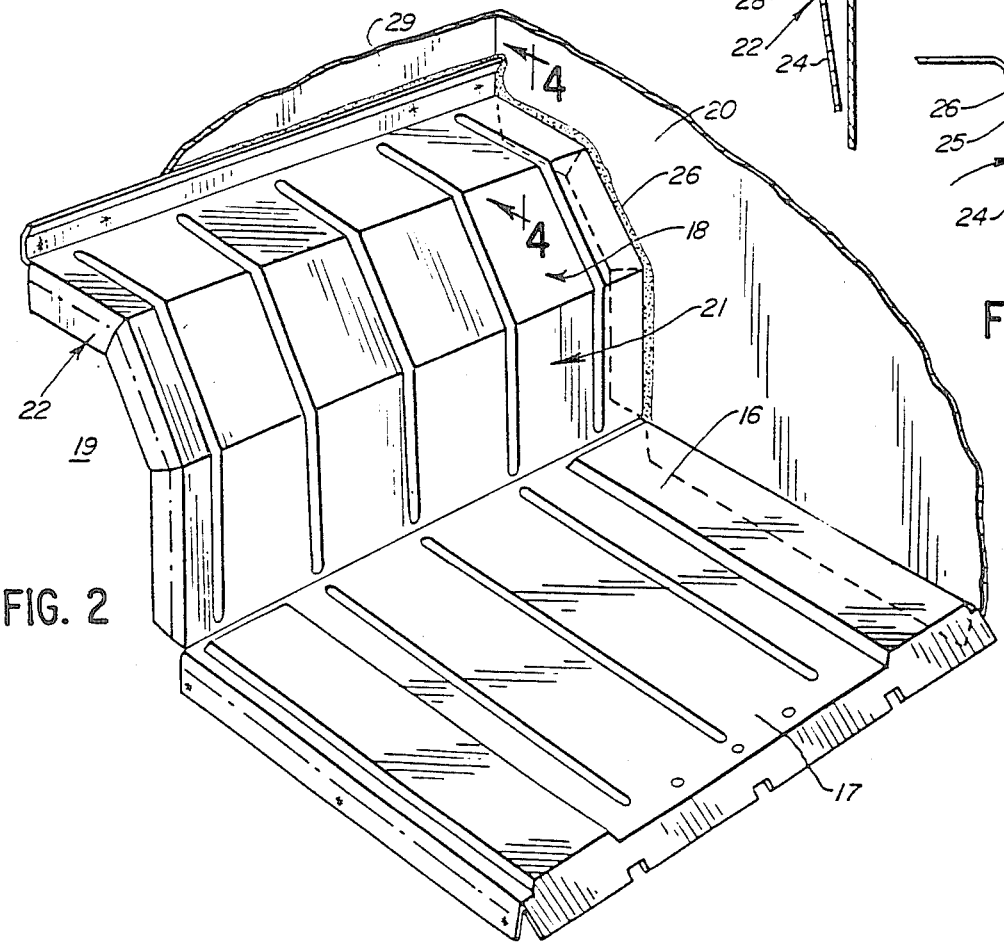
FIG. 2

METHOD OF MANUFACTURING REFRIGERATION APPARATUS CABINET CONSTRUCTION UTILIZING PREPAINTED STEEL PANELS

This is a division of application Ser. No. 633,214 filed July 19, 1984, now U.S. Pat. No. 4,640,432.

BACKGROUND OF THE INVENTION

1. Field of the Invention

This invention relates to cabinet constructions and in particular to refrigeration apparatus cabinet structures utilizing deck members.

2. Description of the Background Art

It is conventional in the manufacture of cabinets for appliances, such as refrigerator-freezer appliances, to form the outer shell of the cabinet from sheet steel. The different members defining the shell are welded together and, upon completion of the assembly, the shell is provided with an exterior finish, such as paint. A serious problem in connection with such manufacture is the amount of labor and manufacturing apparatus required.

Recently, the use of prepainted steel panels has been introduced in connection with such manufacture to substantially reduce the total cost of fabrication of such cabinets. However, the use of such prepainted steel sheets raises a serious problem in connection with securing of the sheets to one another at locations where paint discoloration may be seen. Thus, welding of the sheets at these locations is effectively precluded.

In one conventional refrigeration appliance cabinet structure, the lower wall member of the cabinet comprises a deck member which must be secured to the sidewalls and rear wall of the cabinet to define the outer boundary of the insulation space inwardly thereof. As the insulation in such refrigeration appliances is conventionally formed in situ by conventional foaming processes, it is necessary to seal the interface of the deck member with the adjacent upright sidewalls not only to provide a seal against moisture therebetween but also to act as a sealing closure means for the molding cavity defined by the cabinet walls in the foaming process. It is additionally necessary to be able to rigidly secure the deck member to the sidewalls in such a way that bulging of the thin metal of the sidewalls does not result.

It is further conventional in such cabinet constructions to provide a rectangular glider rail frame member on the inner surface of the cabinet upright walls. A lower front portion of the deck member is secured to the frame member as by spot welding. This portion of the assembly is subsequently covered with a prepainted steel panel and, thus, any visual effects caused by the welding are not observable.

However, the rear portion of the deck member is upwardly spaced from the glider rail and, thus, would have to be welded directly to the shell wall. As the shell wall comprises conventionally a prepainted steel wall in this form of construction, such welding would cause paint discoloration.

One attempted solution to this problem is disclosed in U.S. Pat. No. 3,948,407 of Richard L. Puterbaugh, wherein right angle flanges are provided on the edges of the deck member. The manufacturing tolerances utilized in conjunction with such cabinet manufacture do not permit accurate fit between the deck member and the sidewalls in all cases and, thus, in those structures wherein the tolerances cause a gap, masking of the joint to prevent leakage of the foam during the foaming operation must be effected. Alternatively, where the tolerances cause an interference fit with the sidewalls, unsightly bulging of the thin sheet metal sidewall occurs. Thus, such a structure does not offer a completely satisfactory solution to this vexatious problem.

SUMMARY OF THE INVENTION

The present invention comprehends an improved cabinet wall construction including a first cabinet wall, a second cabinet wall defining a first, transverse portion extending toward the first wall and having a second, edge portion adjacent said first wall, the second portion comprising a turned portion of the second wall connected to the transverse portion thereof by a yieldable hinge connection, the second portion being deflected about the hinge connection as an incident of the engagement of the distal end of the second portion with the first wall and defining therewith a deep, tapered crevice to receive sealant material, and a preselected quantity of flowable sealant adhesive material in the crevice.

Further, the invention comprehends the provision of a cabinet wall structure including biasing means associated with the turned portion of the second wall for resiliently biasing the turned portion to extend outwardly toward the first wall and define therewith a long, tapered sealant receiving crevice.

In the illustrated embodiment, the cabinet wall structure is utilized as a refrigerator cabinet structure and includes a metal shell, a liner nested within the shell in spaced relationship thereto, and insulation formed in situ between the shell and the liner, the metal shell comprising two prepainted sidewalls each having an inner face and an outer face, a prepainted top continuous with the upper end of the sidewalls, a rear panel attached to the sidewalls and the top, a generally horizontal deck member forming the lower wall of a space in which the liner is nested, the deck member having an edge proximately spaced from the inner face of one of the sidewalls and an angled flange extending from the edge and obliquely contacting the inner face forming a tapered crevice therewith, and substantially moisture-impervious sealing means disposed in the crevice.

The invention comprehends the utilization of a hot melt sealing means which flows fully into the sealant space at an elevated temperature, but solidifies after being cooled by contact with the metal surfaces of the cabinet, to provide an improved sealing effect in the cabinet construction.

In the illustrated embodiment, the turned portion of the deck member includes a series of wall portions hingedly connected so that the distal end portion may be in facial engagement with the sidewall of the cabinet, with the manufacturing tolerances being accommodated by the variable angular extension of the portion of the turned portion of the deck member connecting the distal portion to the transverse portion thereof.

In the illustrated embodiment, the turned portion comprises two planar portions sequentially hingedly connected to the transverse portion by resiliently deflectible hinge line portions.

The cabinet wall structure of the present invention is extremely simple and economical of construction while yet providing an improved, simplified manufacture, permitting the use of prepainted panels in the forming of the cabinet structure by eliminating the need for welding locations where paint discoloration would be observable in the final cabinet structure.

BRIEF DESCRIPTION OF THE DRAWING

Other features and advantages of the invention will be apparent from the following description taken in connection with the accompanying drawings wherein:

FIG. 1 is a perspective view of a refrigeration apparatus cabinet having all structure embodying the invention;

FIG. 2 is a fragmentary perspective view illustrating the wall structure of the present invention in greater detail;

FIG. 3 is a fragmentary vertical section illustrating the movement of the cabinet sidewall into facial engagement with the distal end of the transverse wall edge portion to effect the desired joint therebetween; and FIG. 4 is a fragmentary vertical section illustrating the final arrangement of the structure of FIG. 3, with the hot melt sealant provided therein.

DESCRIPTION OF THE PREFERRED EMBODIMENT

In the illustrative embodiment of the invention as disclosed in the drawing, a cabinet generally designated 10 is shown in FIG. 1 to comprise a refrigerator-freezer cabinet having a horizontal mullion 11 dividing the internal space of the cabinet into a freezer compartment 12 and a fresh food refrigeration compartment 13. The cabinet is defined by an outer shell 14 and an inner liner 15 between which foamed-in-place insulation is provided in situ (not shown).

The cabinet is further defined by a lower deck member 16 which defines the bottom of outer shell 14.

As shown in FIG. 2, deck member 16 comprises a formed sheet steel wall member having a forward horizontal portion 17 and a rear upstanding enclosure portion 18 defining a rear machinery space generally designated 19, in which operating apparatus of the appliance may be mounted.

The present invention is concerned with the provision of means on the enclosure portion 18 for providing a seal and an abutting attachment between the enclosure portion and the upstanding sidewalls 20 and 30 of the cabinet outer shell 14 into which the deck member is fitted. As discussed briefly above, welding of the edges of the enclosure portion 18 to the upstanding sidewalls 20 and 30 is undesirable as such welding causes discoloration of the prepainted panels of which the sidewalls are formed. The present invention provides such a sealed connection in a novel and simple manner.

More specifically, as shown in FIG. 3, the upstanding enclosure portion 18 includes a first, transverse wall portion 21 extending to adjacent upstanding sidewall 20 and having a second, edge portion generally designated 22 adjacent sidewall 20. Though not shown, the same relationship exists between upstanding enclosure portion 18 and sidewall 30.

As shown in FIG. 3, edge portion 22 comprises a turned portion of the enclosure portion 18 connected to the transverse wall portion 21 thereof by a yieldable hinge connection 23. The edge portion 22 is deflectible about the hinge connection 23 as an incident of the engagement of the distal end portion 24 thereof with the cabinet sidewall 20, as illustrated in FIG. 4.

As further shown in FIG. 4, the cooperating edge portion 22 and sidewall 20 define, in the assembled arrangement, the tapering sealant space, or cavity, 25 in which a suitable hot melt sealant 26 is provided. The liquefying of the sealant permits it to flow fully down into the tapered cavity 25 to provide an improved seal between the deck member and cabinet shell wall to provide the necessary dam therebetween during the in situ insulation foaming process. It is believed by the inventors that a combination of capillarity and gravity cause the sealant to flow fully and evenly into tapered cavity 25. The extended depth of cavity 25 ensures that the hot melt sealant 26 will cool sufficiently to solidify before leaking from cavity 25. Hot melt sealant 26 may comprise a combination of an amorphous polypropylene and a butyl rubber, with an inorganic filler such as calcium carbonate.

In the illustrated embodiment, the edge portion 22 of the enclosure portion 18 includes a first turned portion 27 connected to the transverse wall portion 21 by the hinge connection 23. The distal end portion 24 is connected to the first turned portion 27 by a second hinge connection 28 and extends at an included angle to the transverse wall portion 21, which is somewhat smaller than the angle at which the first portion 27 extends thereto. Thus, in the assembled relationship illustrated in FIG. 4, the distal end portion 24 may be brought readily into facial engagement with the inner surface of the sidewall 20, with the first turned portion 27 providing for variable disposition of portion 24 within the manufacturing tolerances involved.

Hinge connections 23 and 28 are resilient and function to bias turned portion 27 and distal end portion 24 in the direction of sidewall 20. Hinge connections 23 and 28 function as serially operable biasing means assuring adequate, but not excessive, facial contact pressure between distal end portion 24 and sidewall 20.

In the illustrated embodiment, the shell, or wrapper, sidewall 20 is formed of prepainted 0.019" thick steel and deck member 16 is formed of galvanized 0.018" thick steel.

The provision of the double hinge connection in the edge portion 22 provides a funnel-like effect in the upper portion of the cavity 25 readily receiving the hot melt as a synergistic further feature of the construction.

As seen in FIG. 1, the outer shell 14 effectively defines a U-shaped wrapper including a top wall portion 32 and a left sidewall 30 opposite sidewall 20. In forming the cabinet construction, the sidewalls 20 and 30 may be caused to extend angularly outwardly so as to form a divergent, substantially parallelepiped space into the lower portion of which the lower deck member 16 is placed. The diverging sidewalls 20 and 30 are then caused to be moved inwardly along the bendline joints 31 at opposite sides of the top wall portion 32. Thus, the opposite sidewalls 20 and 30 move inwardly into engagement with the edge portions 22 at opposite sides of the deck enclosure portion 18. Thus the assembly is essentially self-centering. However, if the deck member is displaced from a centered relationship with the sidewalls, the end portions 22 accommodate the variation in the spacing as well as the manufacturing tolerances in the preformed structures, as discussed above. A galvanized steel rear wall portion 29 is attached to the cabinet top wall portion 32, sidewalls 20 and 30, and deck member 16 using conventional techniques.

The edge portions 22 effectively comprise turned flanges and the resilient hinge connections 23 and 28 are formed by bending the sheet metal along the hinge connection lines. Thus, the manufacture of the deck member is extremely simple and economical of construction while yet permitting the facilitated conventional tolerance accommodation and sealant reception discussed above.

The elimination of the need for welding of the side flanges of the deck member portion 18 to the outer sidewalls 20 and 30 obviates the problem of discoloration as caused by the conventional welding securing means. The deflectibility of the hinge connections 23 and 28, as well as the deflectibility of the distal end portion 24 permits facilitated facial engagement of the distal portion 24 with the sidewall 20, as illustrated in FIG. 4, without undesirable bulging of the sidewall notwithstanding the relatively thin sheet metal construction thereof.

The foregoing disclosure of specific embodiments is illustrative of the broad inventive concepts comprehended by the invention.

Having described the invention, the embodiments of the invention in which an exclusive property or privilege is claimed are defined as follows:

1. A method of assembling a plurality of sheet metal walls into an outer shell of a refrigeration apparatus cabinet to have a preselected width, comprising the steps of:

forming a U-shaped cabinet member having opposite, outwardly diverging planar sidewalls;

forming a deck member having a width greater than said preselected width;

forming obtusely angled flanges extending outwardly from opposite side edges of said deck member, said opposite side edges being spaced apart a distance less than said preselected width and said flanges having outer end portions spaced apart a distance greater than said preselected width;

wrapping said cabinet member about said deck member with said angled flanges extending into engagement with said sidewalls;

positioning said sidewalls in parallel relationship, whereby each of said sidewalls deflects the confronting flange and forms a tapered cavity therewith without substantial deflection of the sidewalls by-said flanges; and flowing a substantially moisture-impermeable sealing material into said cavity.

2. The method of assembling a sheet metal outer shell of claim 1 including the step of prepainting the sheet metal walls.

3. The method of assembling a sheet metal outer shell of claim 1 wherein said moisture-impermeable material comprises a hot melt adhesive material.

4. The method of assembling a sheet metal outer shell of claim 1 wherein the step of flowing the moisture-impermeable material into said cavity comprises the steps of depositing a quantity of flowable sealant sufficent to fill said cavity at the open end of said tapered cavity and allowing said sealant to flow into said cavity to the point where said flanges contact said sidewalls.

* * * * *